United States Patent [19]

Zook

[11] 4,347,773

[45] Sep. 7, 1982

[54] MUSICIAN'S PICK

[75] Inventor: Steven T. Zook, Long Beach, Calif.

[73] Assignee: Ronald F. Vaughn, Long Beach, Calif.

[21] Appl. No.: 225,665

[22] Filed: Jan. 16, 1981

Related U.S. Application Data

[63] Continuation-in-part of Ser. No. 65,859, Aug. 3, 1979, abandoned.

[51] Int. Cl.[3] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 1,547,560 | 7/1925 | Burdwise | 84/322 |
| 3,442,169 | 5/1969 | Bowers | 84/322 |
| 3,735,663 | 5/1973 | Cowell | 84/322 |

OTHER PUBLICATIONS

DAVID WEXLER & CO., Catalog No. 66, p. 127, 1965.

*Primary Examiner*—Lawrence R. Franklin

*Attorney, Agent, or Firm*—Fulwider, Patton, Rieber, Lee & Utecht

[57] ABSTRACT

A musician's pick (10) having both a pick portion (26) and an upper grip portion (24). The pick portion (26) and upper grip portion (24) are angularly oriented each with respect to the other in a predetermined manner. Grip portion (24) is generally semi-circular in contour and includes a predetermined diameter adapted to interface with the thumb and forefinger of a user on opposing surfaces thereof. The pick portion (26) includes a predetermined extended length adapted to engage strings (14) of a guitar (12) at a predetermined depth when the grip portion (24) is interfaced by the thumb and forefinger of the user. The predetermined angular orientation between the pick portion (26) and the grip portion (24) of the pick (10) allows the pick portion (26) to engage the strings (14) in a generally parallel relation despite the normal, non-parallel relation between the strings (14) and the longitudinal axis (20) of a user's forearm (18).

4 Claims, 7 Drawing Figures

MUSICIAN'S PICK

REFERENCE TO RELATED APPLICATIONS

This is a Continuation-in-Part of my U.S. patent application Ser. No. 065,859, filed Aug. 3, 1979, now abandoned.

BACKGROUND OF THE INVENTION

FIELD OF THE INVENTION

The present invention relates to a musician's pick for playing a stringed instrument. In particular, the subject invention directs itself to a musician's pick having a grip portion and a pick portion angularly oriented each with respect to the other. More in particular, this invention pertains to a musician's pick of predetermined size to allow comfortable interfacing of the user's thumb and forefinger on opposing surfaces of the grip portion of the pick. Still further, this invention relates to a musician's pick where the pick portion includes a predetermined length to optimize the depth beneath the strings being played while allowing the user to maintain a comfortable positional relation with respect to the stringed instrument. Still further, this invention pertains to a musician's pick having both a pick portion and a grip portion interfaced by an intermediate section defining a pair of shoulders which provide stops for the musician's forefinger and thumb.

PRIOR ART

Various forms of picks are utilized for playing stringed instruments. The best prior art known to the Applicant are U.S. Pat. Nos. 1,547,560 and 3,442,169. Both of these references direct themselves to picks for stringed instruments. Additionally, such picks shown provide for a twist in the overall pick contour. However, neither of the references provide for the overall concept of locating the thumb and forefinger both in a secure and comfortable manner on the pick while simultaneously delineating the tip size and shape to provide proper pick depth for interfacing with the strings of the stringed instrument. Such references merely provide for a twist in the shape of contour of the prior art picks and do not optimize the geometric dimensions to provide increased tonal quality while allowing comfort in the gripping action by the user.

Other prior art picks are curved which have lateral extensions adapted to be disposed about the fingers for playing a stringed instrument, such as the Hawaiian guitar. However, the subject invention has particular utility with respect to generally planar or flat picks of the type used in playing a stringed instrument, like a hollow body electric guitar.

Other prior art picks for playing electric guitars or the like are normally formed out of somewhat resilient sheet plastic material, or some like composition. The upper or grip portion is typically characterized by a relatively large radius upper edge extremity, and by side edges which converge downwardly to a pointed, relatively small radius pick portion for engagement with the guitar stings.

One disadvantage of this type of guitar pick is that it must be relatively tightly gripped to prevent it from rotating or sliding between the thumb and forefinger. Rotation undesirably locates the pick portion out of alignment with the guitar strings, while sliding adversely affects location of the pick portion at the proper depth relative to the strings.

In addition, the tonal quality of a guitar is significantly affected by the orientation of the plane of the pick portion relative to the strings. Optimum tonal quality is achieved when the string is strummed or picked with the plane of the pick portion generally parallel to the axis of the string, rather than the picking the string with the edge of the pick. However, the normal position of a musician playing an electric guitar locates the axis of the forearm at an angle of approximately 20.0° relative to the axes of the strings, the angle varying somewhat according to the physical characteristics of the musician. This also places the plane of the pick at the same approximate angle relative to the strings due to the fact that the plane of the pick when held naturally and comfortably between the thumb and forefinger, will normally be approximately parallel to the longitudinal axis of the musician's forearm.

Some musicians compensate for this undesirable angular inclination of the pick by placing the end of the guitar in the crook of the arm so that the forearm extends from the end of the guitar in approximately alignment with the strings, and thereby similarly locating the plane of the pick in general alignment with the strings. However, this position is uncomfortable and fatiguing.

Other musicians have attempted to compensate for the undesirable angular inclination of the pick by upwardly cocking or pivoting the hand at the wrist until the plane of the pick is parallel to the strings, but this has also been found to be fatiguing. Moreover, it requires more concentration on technique rather than the music.

As a consequence of the foregoing, most musicians playing a stringed instrument such as the guitar either hold the pick in a relaxed manner and suffer the loss of tonal quality which results when the side edge of the pick engages the strings, or they cock their wrist and experience the fatigue accompanying this cramped position. In addition, it has been found that cocking of the wrist tends to make it more difficult to rapidly strum the strings when playing music having a fast tempo.

SUMMARY OF THE INVENTION

A musician's pick is provided with a grip portion adapted to be gripped between the thumb and forefinger of a musician generally parallel to the longitudinal axis of the musician's forearm. The grip portion is generally semi-circular in contour and has a predetermined diameter adapted to interface with the thumb and the forefinger on opposing surfaces thereof. A pick portion is also provided adjacent the grip portion and adapted for engaging a string of a stringed instrument with the pick portion having a predetermined extended length adapted to engage the string at a predetermined depth when the grip portion is interfaced by the thumb and forefinger. An intermediate portion integrally joins the grip portion and the pick portion at an angle such that the pick portion is adapted to engage the strings in generally parallel relation, despite a non-parallel relation between the strings and the longitudinal axis of the musician's forearm. The intermediate portion includes a pair of oppositely oriented shoulders which are each characterized by a planar portion to serve as stops for the thumb and forefinger of the musician.

In one embodiment of the invention, the intermediate portion is defined by twisting the grip portion relative to the pick portion during fabrication of the pick. Such twisting forms oppositely disposed shoulders which are engageable by the forefinger and the thumb of the user. This facilitates placement of the pick at the proper pick depth relative to the strings and tends to prevent rotation and slippage of the pick during playing.

The angular relation between the grip and the pick portion also makes it much easier to rapidly strum the strings since normal rotation of the hand about the axis of the forearm occurs without any unnatural bending, craming, or awkward orientation of the hand or forearm.

Other objects and features of the present invention will become apparent from consideration of the following detailed description taken in connection with the accompanying Drawing.

DESCRIPTION OF THE PREFERRED EMBODIMENTS

Referring now to FIGS. 1–7, there is shown musician's pick 10, according to the present invention, for playing stringed instruments, such as hollow body jazz or electric guitar 12. Guitar 12 includes the usual plurality of strings 14 which extend generally parallel to longitudinal axis 16 of guitar 12.

Figure 2:
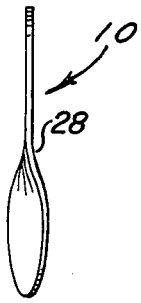
FIG. 2 is a side elevational view of the pick of FIG. 1.
Figure 3:
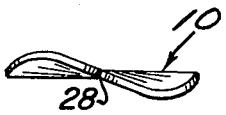
FIG. 3 is a top plan view of the pick of FIG. 1.
Figure 6:
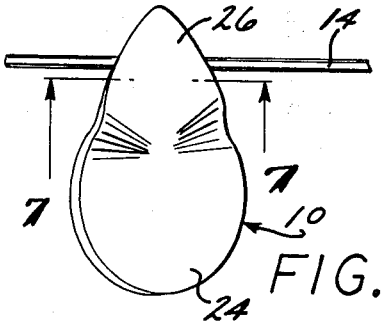
FIG. 6 is a side elevational view of the pick and string of FIG. 5; and, FIG. 7 is a view taken along the section line 7—7 of FIG. 6.

One of the main considerations in the development of pick 10 is to provide an overall twisted contour as is clearly seen in FIGS. 2 and 3, while simultaneously providing an overall counter which functions to locate the thumb and forefinger of a musician securely as well as comfortably on pick 10. The overall contour and size of pick 10 must further provide in combination with the previous concepts, a tip sizing, as well as contour, which allows proper pick depth upon engagement of strings 14, as is seen in FIG. 6. As will be seen in following paragraphs, shoulders 30 are provided between upper grip portion 24 and pick portion 26 at a predetermined positional location to allow for the combination of proper pick depth, as well as a comfortable and secure emplacement of the thumb and forefinger of the user.

Although the present invention is described in connection with guitar 12, pick 10 may be equally adapted for use in playing various other types of guitars and stringed instruments, such as solid body electric guitars, classical or Spanish guitars, steel string acoustic guitars, and solid body bass guitars.

Pick 10 may be formed of a number of material compositions, however, such would preferably be formed of a material composition having deformable properties with a memory such that once deformation takes place, pick 10 will maintain the deformation in the proper contour. One material which has successfully been used is a relatively resilient plastic having an approximate thickness of 0.035 inches. The overall unique configuration, as will be seen in following paragraphs may be imparted thereto by heating and twisting a thermoplastic sheet material, or in the alternative, by forming such in a mold.

Figure 1:
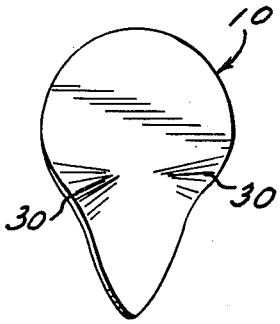
FIG. 1 is a front elevational view of a musician's pick according to the present invention.

As can be seen in FIG. 1, the overall contour of pick 10 is generally tear-drop in overall geometry, and is adapted in size to simultaneously allow a comfortable fit within the hand as well as to facilitate picking of strings 14. Upper grip portion 24 is generally semi-circular in contour having a relatively large diameter adapted to interface with the thumb and forefinger on opposing surfaces thereof. Upper grip portion 24 defines a generally planar surface with the side edges converging downwardly which terminate in a generally planar lower or pick portion 26 including an arcuate relatively small radius point or pick end. In order to achieve the combination of comfortable and secure locations for the forefinger and thumb, while allowing for proper pick depth, the overall extended length of pick 10 is approximately 1.0 inches in length. Additionally, the diameter of upper grip portion 24 has been found to be optimized at approximately 0.70 inches.

Figure 5:
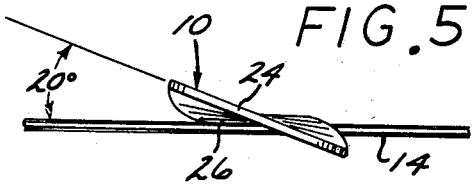
FIG. 5 is an enlarged top plan view of the present pick as it appears upon engagement with one of the strings.

Grip portion 24, which is adapted to be gripped between the thumb and forefinger of the musician or other user, and adjacent pick portion 26 which is adapted for engaging strings 14, as is clearly seen in FIG. 6, are integrally joined by intermediate portion 28, shown in FIGS. 2 and 3. Intermediate portion 28 preferably constitutes the twisted section which would result if grip and pick portions 24 and 26 respectively were twisted relative to each other until their respective planes were angularly off-set at an angle of approximately 20.0°, as is shown in FIG. 5.

As has previously been described, pick 10 may be molded, in which case intermediate portion 28 may take any shape suitable to off-set the portions 24 and 26 at the generally indicated angulation. A particular angulation may vary according to the physical characteristics of the musician, as will be seen, and pick 10 may be marketed with various angulations as desired. However, 20.0° angulation has provided satisfactory results in commercial marketing for typical musicians or other users' use.

Intermediate section 28 is particularly formed approximately one-half the extended length of pick 10. Thus, it has been found advantageous to positionally locate twisted or intermediate section 28 approximately 0.50 inches from an end point of pick portion 26.

Figure 4:
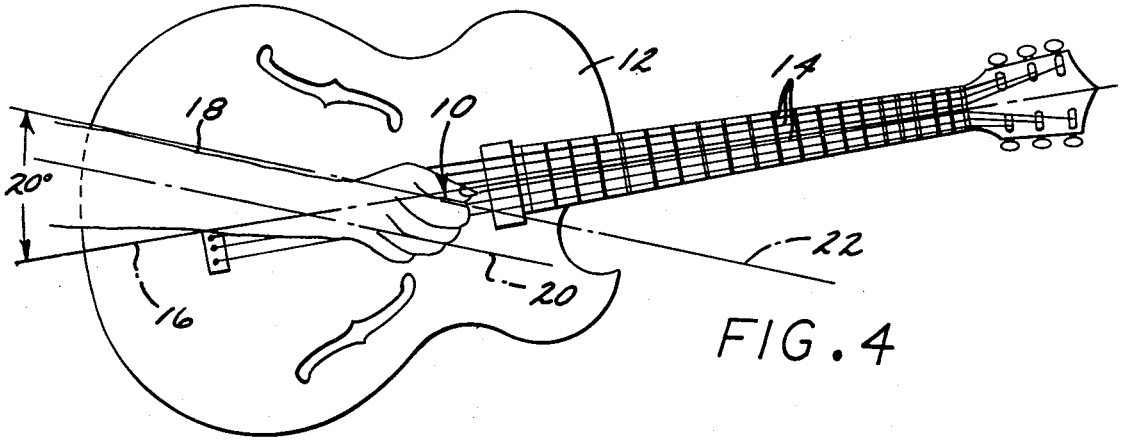
FIG. 4 is a side elevational view of a typical hollow body electric guitar, showing the typical angular inclination of the musician's forearm relative to the strings.

As seen in FIG. 4, forearm 18 of the user is illustrated in a typical relaxed position assumed in playing guitar 12. Forearm axis 20 is typically disposed at an angle of approximately 20.0° to guitar axis 16.

When other prior art planar guitar picks are held between the thumb and forefinger of the user, the plane of the prior art picks fall within a plane 22 which is generally parallel to the forearm axis 20. In this position, such prior art picks undesirably strike strings 14 at an angle unless the user cocks his or her hand upwardly at the wrist so as to place the plane of such prior art picks parallel with strings 14. Such a cramping of the hand has been generally found to be uncomfortable and fatiguing.

Figure 7:
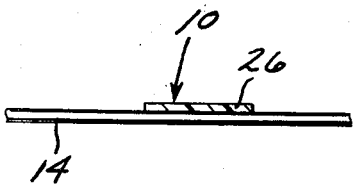

In contradistinction, the angulation and sizing of pick portion 26 relative to grip portion 24 orients pick portion 26 in a manner such that it is adapted to engage string 14 with the plane of pick portion 26 being generally parallel to the string axis as is clearly seen in FIGS. 5 and 7, despite the typical non-parallel relation between string 14 and forearm axis 20. Additionally, with the size of pick portion 26 being approximately 0.50 inches in length, the depth of the pick below strings 14 is optimized into the range of between 0.10 and 0.45 inches. In overall combination, this provides excellent tonal quality, while allowing picking of strings 14 with a comfortable relaxed rotation of the hand about forearm axis 20. The natural motion of the hand during strumming greatly reduces fatigue and enables significantly more rapid and controlled strumming of the strings than was previously possible with other prior art conventional guitar picks.

Still further, in addition to providing an improved tonal quality and reducing musician fatigue, pick 10 is more easily and positively controlled by the musician or other user. As is seen in FIG. 1, the twisted configuration of intermediate portion 28 is relatively abrupt to thereby define a pair of oppositely disposed shoulders 30 which are each characterized by a flat or planar portion to serve as stops or guides for the thumb and forefinger of the musician. The forefingers and thumb of the user rest naturally upon shoulders 30 and thus, shoulders 30 tend both to prevent the pick from rotating in plane 22, and from slipping toward or away from string 14 during use. Consequently, pick 10 is more easily maintained at a proper orientation and pick level for optimum engagement with strings 14. Due to the fact that during use, frictional constrainment is the only mode of holding pick 10 between the thumb and forefinger of the user, during strumming or other contact with strings 14, there is a tendency of movement or displacement of upper grip portion 24 between thumb and forefinger. Shoulders 30 provide a positive stop against which the thumb and forefinger may be maintained. This allows for a constant optimum depth of pick portion 26 below strings 14 in a controlled displacement.

As has been previously described, the optimum angulation of 20.0° has been found to be useful for most users, however, such angulation may be varied. For example, the forearm of a taller user or musician will normally rest at a slightly different angle relative to strings 14, compared to a shorter musician, and the angulation desirable may well be changed to reflect this. Also, the bodies of various types of guitars 12 may vary in configuration and size, and this also will affect the position of the forearm. It is envisioned that such differences may be so pronounced that custom or specially tailored picks may be provided to incorporate an angulation especially suited to the needs of the individual musician or user.

From the foregoing, it is seen that by using the grip and pick portions 24 and 26 at proper angulations, the pick may be more easily and positively controlled, will be adapted to strike strings 14 at a proper angle for optimum tonal quality, will enable the musician to more rapidly strum the strings, and permits use of a natural hand motion that significantly reduces fatigue.

Various modifications and changes may be made with regard to the foregoing detailed description, without departing from the spirit of the invention.

I claim:

1. A musician's pick comprising:

a gripping portion lying generally within a grip plane and adapted to be gripped between the thumb and forefinger of a musician with said grip plane generally parallel to the longitudinal axis of the musician's forearm;

a pick portion adjacent said gripping portion and lying generally within a pick plane, said pick portion having a predetermined extended length adapted to engage an instrument string at a predetermined depth when said gripping portion is gripped between said thumb and forefinger; and, an intermediate portion integrally joining said side grip portion and said pick portion such that said pick plane is angularly inclined relative to said grip plane, thereby enabling orientation of said pick plane parallel to the string despite a non-parallel orientation between the longitudinal axis of the musician's forearm and the string, said intermediate portion including a pair of oppositely oriented shoulders which are each characterized by a planar portion to serve as stops for the thumb and forefinger of the musician, said pick having an overall length of approximately one inch, and said intermediate portion being located midway between the opposite ends of said pick.

2. A musician's pick according to claim 1 wherein said gripping portion is semi-circular in contour having a diameter approximating 0.70 inches.

3. A musician's pick according to claim 1 wherein said angular inclination of said pick plane with respect to said grip plane approximates 20.0 degrees.

4. A musician's pick according to claim 1 wherein said pick is formed of a thermoplastic composition.

* * * * *